US007690759B2

(12) United States Patent
Yamada

(10) Patent No.: US 7,690,759 B2
(45) Date of Patent: Apr. 6, 2010

(54) LIQUID CONTAINER, INK CARTRIDGE AND INK JET PRINTER HAVING INK CARTRIDGE

(75) Inventor: Manabu Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 550 days.

(21) Appl. No.: 11/499,465

(22) Filed: Aug. 3, 2006

(65) Prior Publication Data

US 2007/0030302 A1 Feb. 8, 2007

(30) Foreign Application Priority Data

Aug. 4, 2005 (JP) ..... 2005-227167

(51) Int. Cl.
*B41J 2/165* (2006.01)

(52) U.S. Cl. ..... 347/36

(58) Field of Classification Search ..... 347/31, 347/36, 86

See application file for complete search history.

(56) References Cited

U.S. PATENT DOCUMENTS

| | | | | |
|---|---|---|---|---|
| 4,628,331 | A | 12/1986 | Ishikawa | |
| 5,083,947 | A * | 1/1992 | Dominique et al. | 439/725 |
| 5,221,935 | A * | 6/1993 | Uzita | 347/36 |
| 5,341,164 | A * | 8/1994 | Miyazawa et al. | 347/88 |
| 5,666,146 | A | 9/1997 | Mochizuki et al. | |
| 5,815,183 | A | 9/1998 | Sasaki | |
| 6,033,063 | A | 3/2000 | Tomikawa et al. | |
| 6,227,661 | B1 * | 5/2001 | Hayakawa | 347/86 |
| 6,264,314 | B1 | 7/2001 | Mochizuki et al. | |
| 6,375,305 | B2 * | 4/2002 | Sugimoto et al. | 347/36 |
| 2003/0122910 | A1 | 7/2003 | Koshikawa et al. | |
| 2005/0151807 | A1 * | 7/2005 | Andersen et al. | 347/86 |

FOREIGN PATENT DOCUMENTS

| | | |
|---|---|---|
| JP | 5-4349 | 1/1993 |
| JP | 5-16377 | 1/1993 |
| JP | 8-132633 | 5/1996 |
| JP | 09-066609 A | 3/1997 |
| JP | 2003-341086 A | 12/2003 |

OTHER PUBLICATIONS

The European Search Report for the corresponding European application No. 06016242.7-2304 dated Apr. 2, 2008.

* cited by examiner

*Primary Examiner*—Stephen D Meier
*Assistant Examiner*—Alexander C Witkowski
(74) *Attorney, Agent, or Firm*—Nutter McClennen & Fish LLP; John J. Penny, Jr.

(57) ABSTRACT

A liquid container including: a containing portion, adapted to store liquid; a liquid outlet port, adapted to flow out the liquid from the containing portion therethrough; an outer wall, having a liquid supply opening for exposing the liquid outlet port to an outside, and covering a periphery of the liquid outlet port while the outer wall keeps a predetermined gap from an outer end of the liquid outlet port; and a first liquid absorption member, disposed at the predetermined gap so as to absorb the liquid.

18 Claims, 13 Drawing Sheets

LIQUID CONTAINER, INK CARTRIDGE AND INK JET PRINTER HAVING INK CARTRIDGE

BACKGROUND OF THE INVENTION

1. Technical Field of the Invention

The present invention relates to a liquid container that is mounted on a cartridge mounting portion in a liquid ejection apparatus, such as an ink jet printer or the like.

2. Description of the Related Art

As a liquid container that is mounted on a cartridge mounting portion in a liquid ejection apparatus, such as an ink jet printer or the like, an ink cartridge having the configuration shown in FIG. 14 has been suggested.

An ink cartridge 101 shown in FIG. 14 is disclosed in JP-A-5-16377 described below. The ink cartridge 101 has an ink pack 104 that has a flexible pouch body 102 containing an ink liquid and an ink outlet port 103 provided in the pouch body 102, and a rectangular cartridge case 105 that accommodates the ink pack 104 and is mounted on a cartridge mounting portion of a printer.

In the cartridge case 105, a boxlike case main body 106 having a top opened and a lid body 107 that covers the opened portion of the case main body 106 defines a pack accommodating space 105*a* that accommodates the ink pack 104.

The pouch body 102 is formed by stacking aluminum-laminated films and bonding their circumferential portions to each other using a heat welding method or the like. The aluminum-laminated films are obtained by forming a nylon film and a polyethylene film on both surfaces of an aluminum foil. In addition, the aluminum-laminated films are stacked such that their polyethylene films face each other.

As shown in FIG. 15, the ink outlet port 103 is configured such that a sealing plug 103*b* formed of an elastic material, such as rubber or the like, is press-fitted into and fixed to a cylindrical body 103*a* formed of plastic. A thin film portion 103*c* is provided on the sealing plug 103*b* close to the pouch body 102 so as to prevent the occurrence of eluted products and deposits of impurities due to the insertion of the sealing plug 103*b* that was brought into contact with ink.

A rear end of the cylindrical body 103*a* that is inserted between the superimposed portion of the aluminum-laminated films of the pouch body 102 and the cylindrical body 103*a* is heat-welded to the aluminum-laminated films. Accordingly, the ink outlet port 103 is incorporated into the pouch body 102 in an airtight manner.

As shown in FIG. 14, a pack positioning portion 106*b* is provided at a front-end side wall 106*a* of the case main body 106 so as to position the ink outlet port 103.

As shown in FIG. 15, the pack positioning portion 106*b* is a semicircular notch that is fitted into an anchoring groove 103*d* formed in an outer circumference of the cylindrical body 103*a* of the ink outlet port 103. With the engagement of the pack positioning portion 106*b* and the ink outlet port 103, a front end of the outer end of the ink outlet port 103 is positioned so as to slightly protrude from the cartridge case 105.

If the ink cartridge 101 that accommodates the ink pack 104 is mounted on the cartridge mounting portion of the printer, as shown in FIG. 15, an ink supply needle 108 provided in the cartridge mounting portion passes through the sealing plug 103*b* and the thin film portion 103*c*, such that the ink liquid within the pouch body 102 can be supplied to an ink supply portion of the printer connected to the ink supply needle 108.

If the ink cartridge 101 is mounted on the cartridge mounting portion of the printer in such a manner, the ink supply needle 108 of the printer is inserted into and connected to the exposed ink outlet port 103 at one end of the cartridge case 105. Then, when the ink cartridge is removed from the cartridge mounting portion of the printer for cartridge replacement, a small amount of a remaining ink liquid may leak to the ink outlet port 103 in a state where the ink supply needle 108 is extracted.

In the conventional ink cartridge 101, the front end of the ink outlet port 103 protrudes outside the cartridge case 105. For this reason, an ink liquid leaking from the ink outlet port 103 may drip within the printer and stain the inside of the printer. Further, the ink liquid may flow out from the case and stain the hand of a worker or peripheral matters.

SUMMARY OF THE INVENTION

The invention has been finalized in order to solve the above-described problems, and it is an object of at least one embodiment of the invention to provide a liquid container that, even though liquid leaks from a liquid outlet port when a cartridge case is removed from a cartridge mounting portion of a liquid ejection apparatus, can prevent leakage liquid from flowing out from the cartridge case, an ink cartridge having such a liquid container, and an ink jet printer having such a liquid container.

According to this aspect of the embodiment of the invention, a liquid container comprises: a containing portion, adapted to store liquid; a liquid outlet port, adapted to flow out the liquid from the containing portion therethrough; an outer wall, having a liquid supply opening for exposing the liquid outlet port to an outside, and covering a periphery of the liquid outlet port while the outer wall keeps a predetermined gap from an outer end of the liquid outlet port; and a first liquid absorption member, disposed at the predetermined gap so as to absorb the liquid.

Here, the predetermined gap at which the outer end of the liquid outlet port is positioned and fixed at a position spaced from the liquid supply opening inward is appropriately set depending on properties of the liquid, such as viscosity or fluidity, such that the liquid does not remain between the inner surface of the outer wall having the liquid supply opening formed therein and the outer end of the liquid outlet port as a meniscus.

According to the liquid container having the above-described configuration, the outer end of the liquid outlet port is positioned at the position spaced at the predetermined gap from the liquid supply opening of the outer wall inward. Therefore, when the liquid container is removed from a mounting portion of a liquid ejection apparatus, even though liquid leaks from the liquid outlet port, leakage liquid flows between the inner surface of the outer wall having the liquid supply opening formed therein and the outer end of the liquid output port. At this time, the liquid is collected so as to be absorbed by the liquid absorption member. That is, the liquid rarely flow out from the outer wall of the liquid container.

As a result, when the liquid container is removed from the mounting portion, liquid rarely leaks from the liquid outlet port and rarely stains the inside of the liquid ejection apparatus or the outer surface of the liquid container.

For this reason, even though the liquid supply opening of the removed liquid container is turned downward, the collected liquid rarely flows backward and rarely leaks from the liquid supply opening of the liquid container to the outside. Therefore, it is possible to improve reliability for a function of collecting the leakage liquid.

In this case, the first liquid absorption member may cover the outlet port to decrease an exposed portion of the outlet port from the liquid supply opening.

Accordingly, liquid leaking from the liquid outlet port can be prevented from flowing out from the liquid outlet port. Further, liquid stuck to a liquid supply member of the mounting portion to be inserted into the liquid outlet port can be absorbed by the liquid absorption member.

The first liquid absorption member may cover the outlet port such that the outlet port is bisected. In this case, since the liquid absorption member and the liquid supply member are reliably brought into contact with each other, liquid stuck to the liquid supply member when the liquid container is removed from the mounting portion can be reliably collected. Therefore, the liquid container can be prevented from being stained by the liquid.

In the liquid container having the above-described configuration, the liquid container may further comprise a liquid storage space, disposed at a position on a downstream side of the inner surface of the outer wall and adapted to store the liquid flowing along an inner surface of the outer wall.

According to the liquid container having the above-described configuration, since the liquid storage space is provided within the liquid container, a collection capability of liquid flowing along the inner surface of the outer wall can be improved.

Therefore, even though the amount of the leakage liquid from the liquid outlet port is increased due to the repetition of the attachment and detachment to and from the mounting portion of the liquid ejection apparatus, the leakage liquid can be reliably collected.

In the liquid container having the above-described configuration, the containing portion may be a liquid pack, and the liquid storage space may be disposed to be lower than a position where the liquid pack is accommodated.

According to the liquid container having the above-described configuration, the liquid that leaks from the liquid outlet port, flows through the liquid absorption member, and then is stored in the liquid storage space does not flow toward the liquid pack, which is accommodated higher than the liquid storage space, unless the cartridge case is horizontally inclined or reversed. Accordingly, the collected liquid can be prevented from being stuck to the liquid pack.

For this reason, it is possible to prevent the occurrence of a situation in which a worker who performs replacement of the liquid pack or the like stains his/her hands with the leakage liquid stuck to the liquid pack. Therefore, operationality and a handling property at the time of the replacement of the liquid pack are improved.

In the liquid container having the above-described configuration, the liquid container may further comprise a second liquid absorption member disposed in the liquid storage space so as to absorb the liquid.

According to the liquid container having the above-described configuration, liquid that leaks from the liquid outlet port, flows through the liquid absorption member, and then is stored in the liquid storage space is absorbed by the liquid absorption member to be then collected. Therefore, even though the removed liquid container is horizontally inclined or reversed, the collected liquid rarely flows backward and leaks from the liquid supply opening of the liquid container to the outside. Therefore, it is possible to improve reliability for a function of collecting the leakage liquid.

Further, in the liquid container having the above-described configuration, the liquid container may further comprise a rib extending along the outer wall to the liquid storage space. The width of the rib may be smaller than an outer diameter of the liquid outlet port and the boundary between the rib and the outer wall may be rounded.

According to another aspect of the invention, an ink cartridge includes the liquid container having the above-described configuration. In this case, an ink liquid is filled in the liquid pack that is accommodated in the liquid container having the above-described configuration.

According to the ink cartridge having the above-described configuration, when the ink cartridge is removed from the cartridge mounting portion, the situation in which an ink liquid leaking from the liquid outlet port stains the printer, peripheral matters, or the hands of a worker rarely occurs.

According to still another aspect of the invention, an ink jet printer includes the ink cartridge having the above-described configuration.

According to the ink jet printer having the above-described configuration, when the ink cartridge is removed from the cartridge mounting portion, ink liquid leaking from the liquid outlet port rarely stains the printer, peripheral matters, or the hands of a worker. Therefore, operationality and a handling property at the time of the replacement of the ink cartridge are improved.

According to the liquid container, the ink cartridge having the liquid container, and the ink jet printer of embodiment of the invention, when the liquid container is removed from the mounting portion of the liquid ejection apparatus, even though the liquid supply member is removed and the liquid leaks from the liquid outlet port, the leakage liquid flows along the inner surface of the outer wall and then is collected by the liquid absorption member. That is, there is no case where the liquid flows out from the liquid container.

Therefore, when the liquid container is removed from the mounting portion, the leakage liquid does not stain the inside of the liquid ejection apparatus or the outer surface of the liquid container. As a result, the inside of the liquid container, peripheral matters of the apparatus, or the hands of a worker are prevented from being stained. In addition, operationality and a handling property at the time of the replacement of the liquid container or the like can be improved.

DETAILED DESCRIPTION OF THE INVENTION

Hereinafter, a liquid container according to a first embodiment of the invention will be described in detail with reference to the accompanying drawings.

Figure 1:
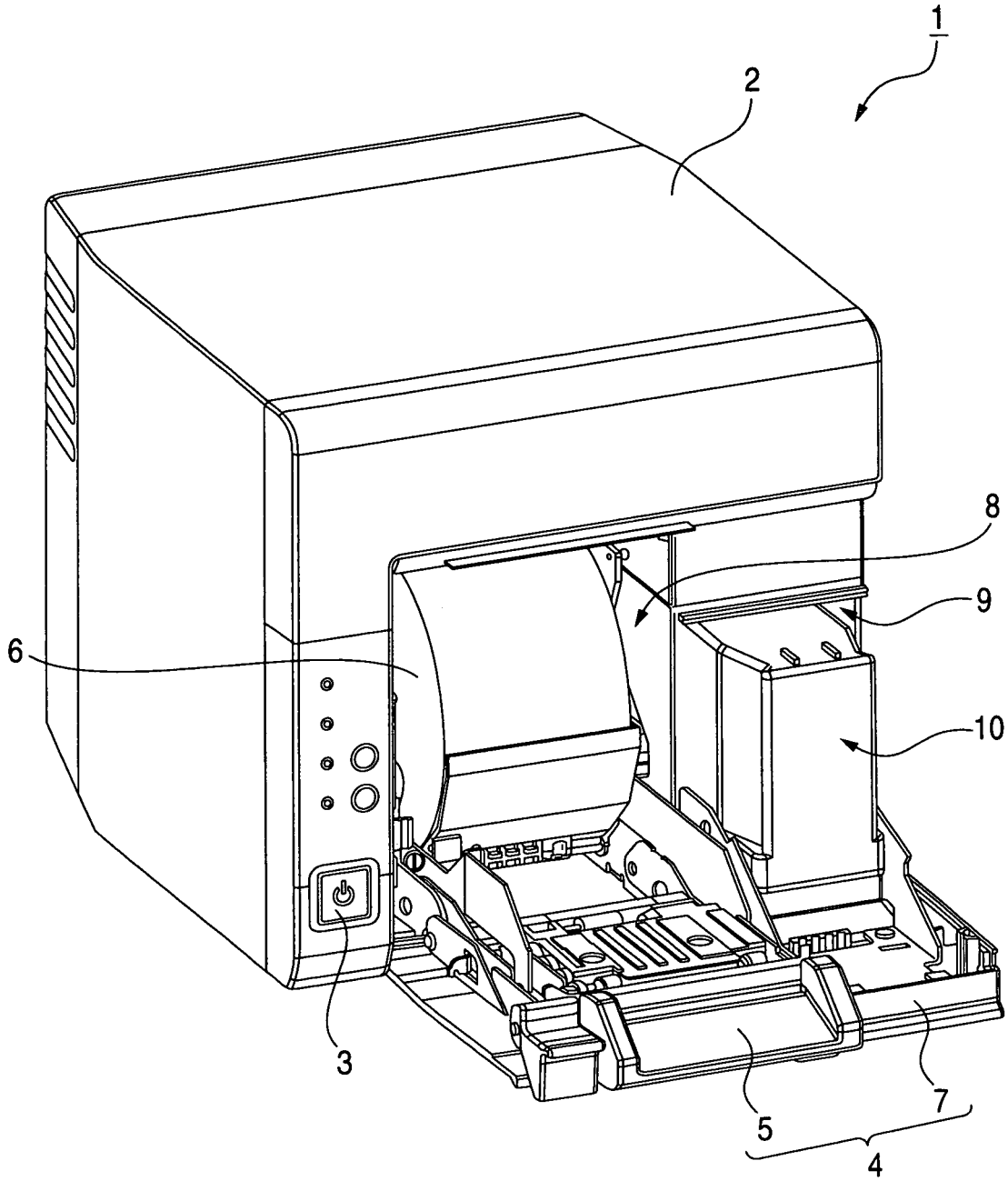
FIG. 1 is an exterior perspective view of an ink jet printer which has an ink cartridge as a liquid container according to an embodiment of the invention.
Figure 6:
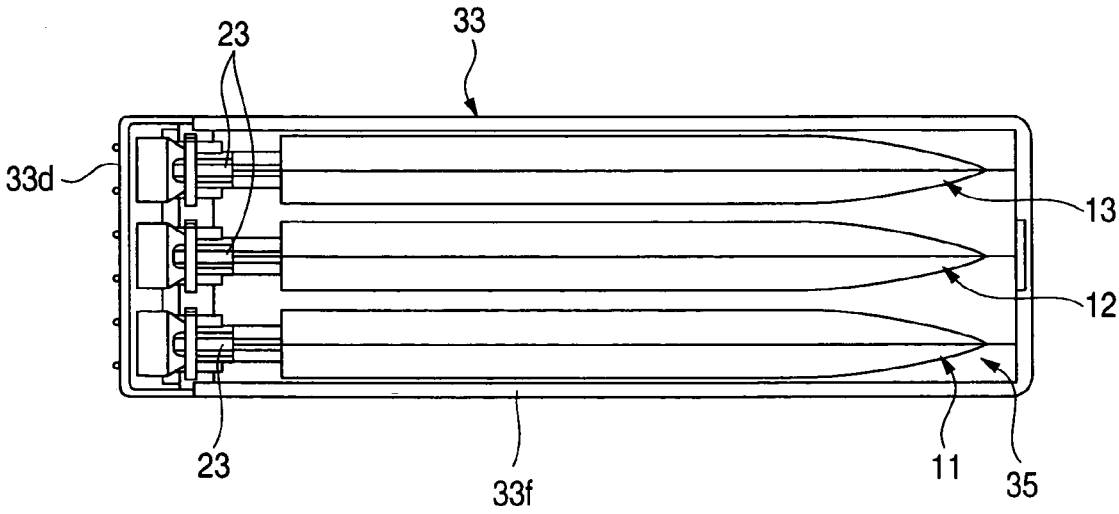
FIG. 6 is a plan view showing a state where an upper case is removed from the ink cartridge shown in FIG. 2.
Figure 7:
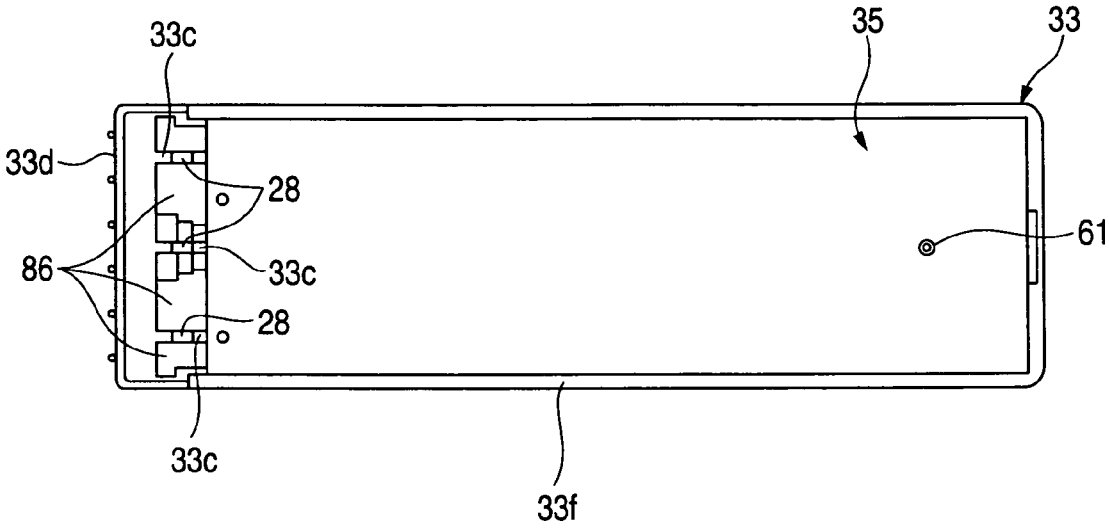
FIG. 7 is a plan view showing a state where an upper case and an ink pack serving as a liquid pack are removed from the ink cartridge shown in FIG. 2.
Figure 8:
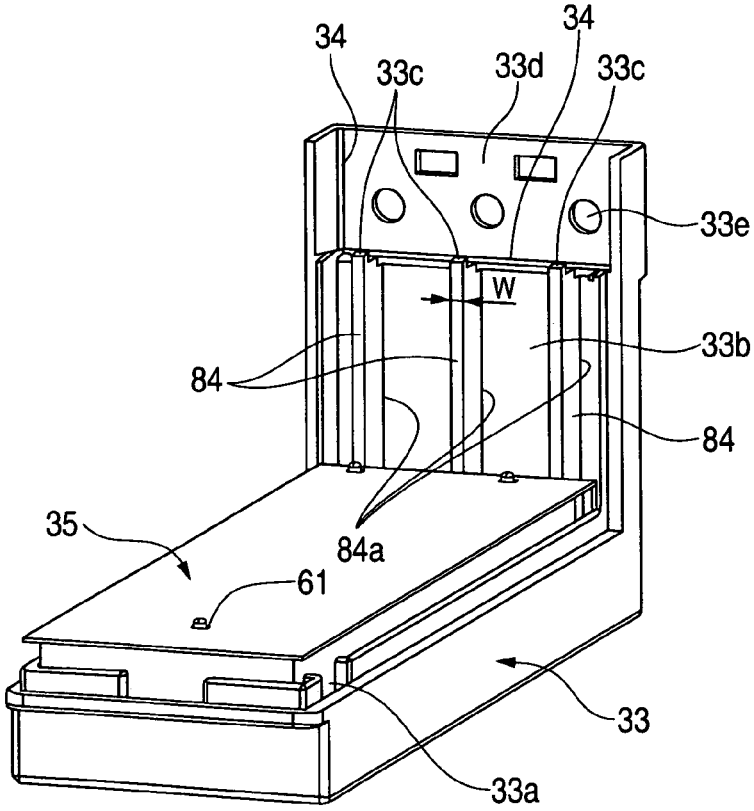
FIG. 8 is a perspective view of the ink cartridge shown in FIG. 7.
Figure 9:
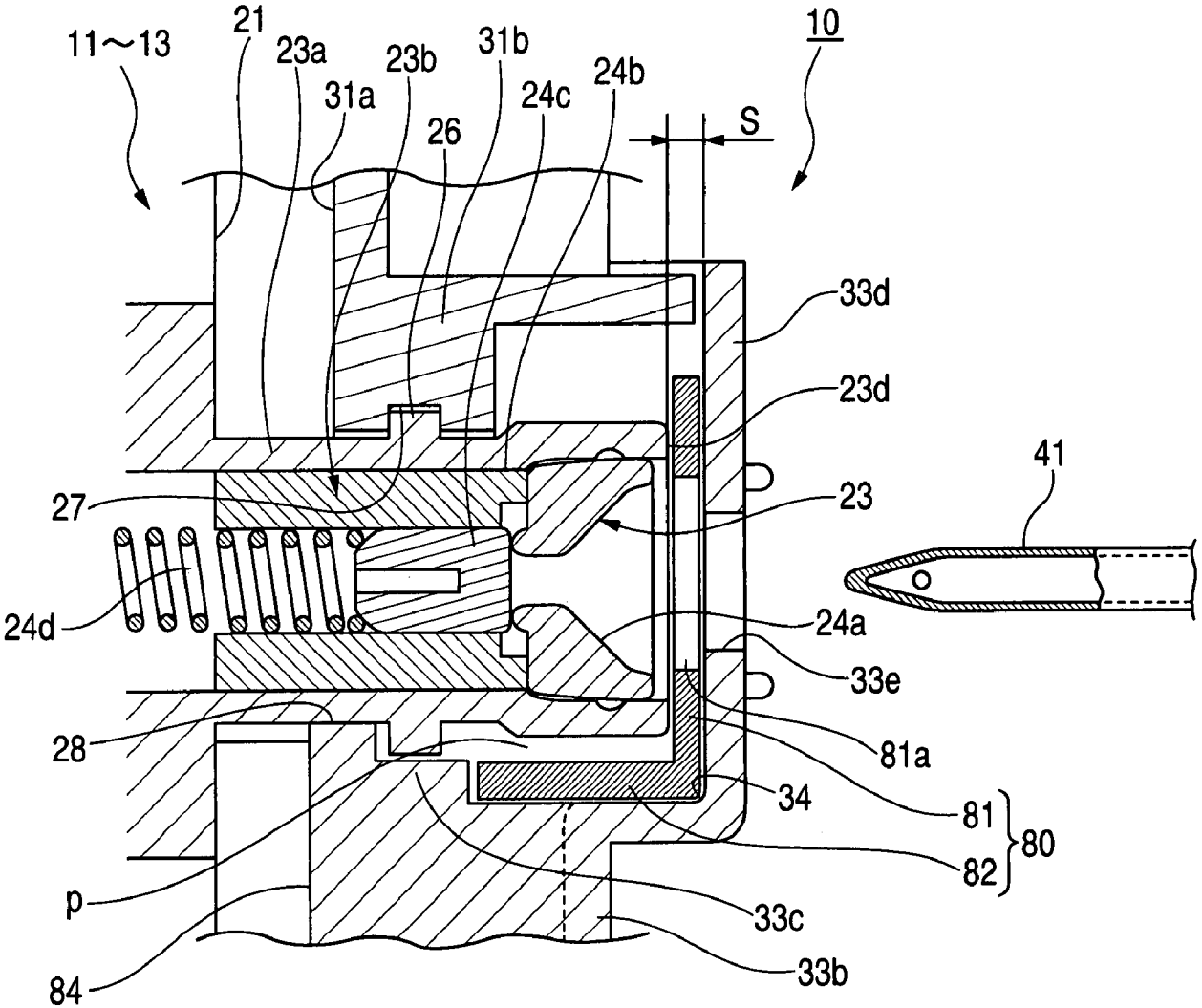
FIG. 9 is an expanded view of a C port opening-closing.

FIG. 1 is an exterior perspective view of an ink jet printer which has an ink cartridge as a liquid container according to an embodiment of the invention. FIGS. 2 to 5 are an overall perspective view, an exploded perspective view, a longitudinal perspective view, and a cross-sectional view of the ink cartridge shown in FIG. 1, respectively. FIG. 6 is a plan view showing a state where an upper case is removed from the ink cartridge shown in FIG. 2. FIG. 7 is a plan view showing a state where an upper case and an ink pack serving as a liquid pack are removed from the ink cartridge shown in FIG. 2. FIG. 8 is a perspective view of the ink cartridge shown in FIG. 7. FIG. 9 is an expanded view of a C port opening-closing. 4.

An ink jet printer 1 according to this embodiment performs color printing on a roll paper using a plurality of color ink liquids. As shown in FIG. 1, a printer cover 4 having a roll paper cover 5 and an ink cartridge cover 7 integrally formed is openably provided on a front surface of a printer case 2. In addition, a power supply switch 3 and feed switches or indicators are disposed on the front surface of the printer case 2.

As shown in FIG. 1, if the printer cover 4 is opened, the roll paper cover 5 that covers a paper accommodating portion 8 for accommodating the roll paper 6 as a printing paper is opened, such that the papers can be replaced. At the same time, the ink cartridge cover 7 that covers a cartridge mounting portion 9 is also opened, such that an ink cartridge 10 can be attached and detached to and from the cartridge mounting portion 9.

In case of the ink jet printer 1 of this embodiment, the ink cartridge 10 is drawn out by a predetermined distance in front of the cartridge mounting portion 9 in connection with an opening operation of the printer cover 4.

As shown in FIGS. 2 to 5, the ink cartridge 10 of this embodiment is mounted on the cartridge mounting portion 9 of the ink jet printer 1. Accordingly, a waste ink storage structure 17 that stores waste ink generated at the time of an ink filling operation or a head cleaning operation of the printer is provided in a cartridge case 15 that accommodates three ink packs (liquid packs) 11 to 13.

The three ink packs 11 to 13 are filled with ink (liquid) of different colors for color printing. The ink packs 11 to 13 have the same structure. Each of the ink packs 11 to 13 has a flexible pouch body 21 that contains ink, and an ink outlet port 23 that is bonded to a front end of the pouch body 21.

The pouch body 21 is formed by superimposing two aluminum-laminated films and bonding their peripheries to each other using a heat welding method or the like. The aluminum-laminated film is used to improve gas barrier characteristics. As the aluminum-laminated film, for example, a laminated film obtained by laminating a nylon film and a polyethylene film on both surfaces of an aluminum foil is used.

Figure 4:
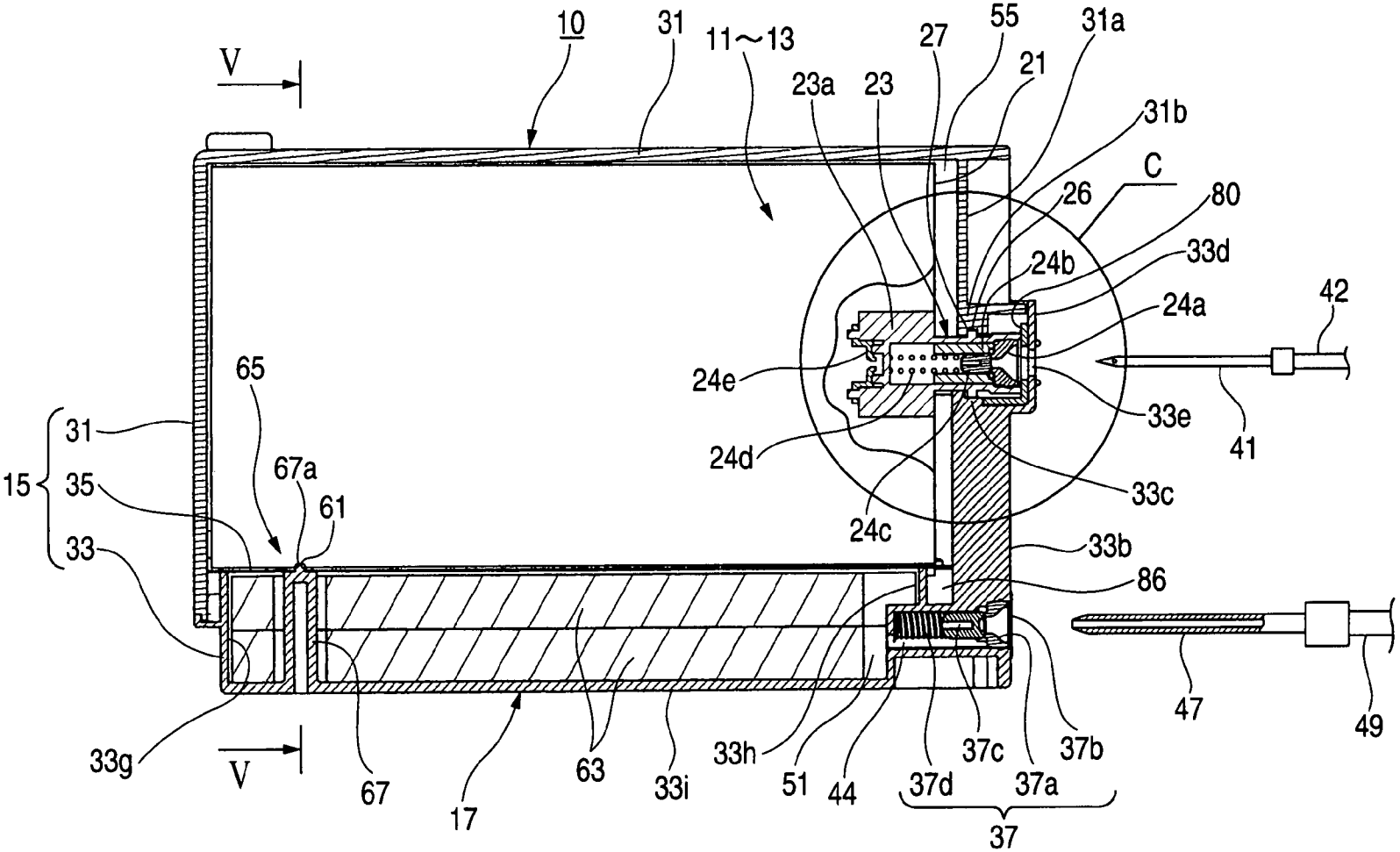
FIG. 4 is a longitudinal perspective view of the ink cartridge shown in FIG. 1.
Figure 5:
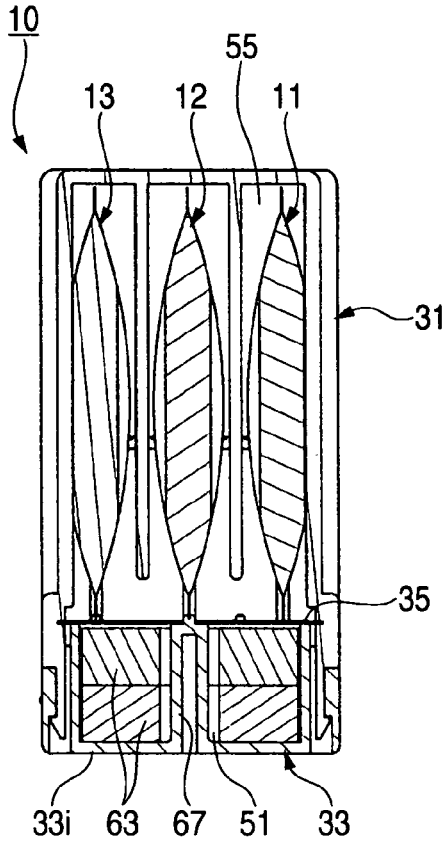
FIG. 5 is a cross-sectional view of the ink cartridge taken along the line V-V of FIG. 4.

In this embodiment, as shown in FIGS. 4 and 9, the ink outlet port 23 has a cylindrical body 23*a* that is formed to have an outer diameter larger than the outer diameter of its front end and is inserted and fixed into the pouch body 21, a valve mechanism 23*b* that is mounted within the cylindrical body 23*a* so as to open/close a flow passage of the cylindrical body 23*a*, and a seal film 23*c* that is attached to the front end of the cylindrical body 23*a* so as to seal an opening of the cylindrical body 23*a*. The cylindrical body 23*a* of the ink outlet port 23 is formed of, for example, hard plastic. Further, the seal film 23*c* is formed of a polyethylene film.

The cylindrical body 23*a* is fixed to the aluminum-laminated film of the pouch body 21 by heat welding or the like, such that the ink outlet port 23 is incorporated into the pouch body 21.

As shown in FIG. 9, the valve mechanism 23*b* has a mouth member 24*a*, formed of an elastic material, such as a rubber material or the like, that is formed in a tapered tube shape having a wider inner diameter at the front end, with which an ink supply needle (liquid supply member) 41 provided in the cartridge mounting portion 9 of the ink jet printer 1 is closely engaged, a guide cylinder 24*b* that is connected to a rear end of the mouth member 24*a* to be concentric with the mouth member 24*a*, a valve body 24*c* that is slidably provided within the guide cylinder 24*b* and comes into contact with the rear end of the mouth member 24*a* so as to seal an opening of the mouth member 24*a*, a compressed coil spring 24*d* that biases the valve body 24*c* in a direction to be brought into contact with the rear end of the mouth member 24*a*, and a spring seat 24*e* that supports one end of the compressed coil spring 24*d* at a base end of the cylinder body 23*a* (see FIG. 4).

In the valve mechanism 23*b*, the ink supply needle 41 provided in the cartridge mounting portion 9 is inserted into the mouth member 24*a*, and then the valve body 24*c* is pressed by the ink supply needle 41 and is press-spaced away from the mouth member 24*a*, such that an ink liquid in the pouch body 21 can be supplied to the ink supply needle 41.

Figure 2:
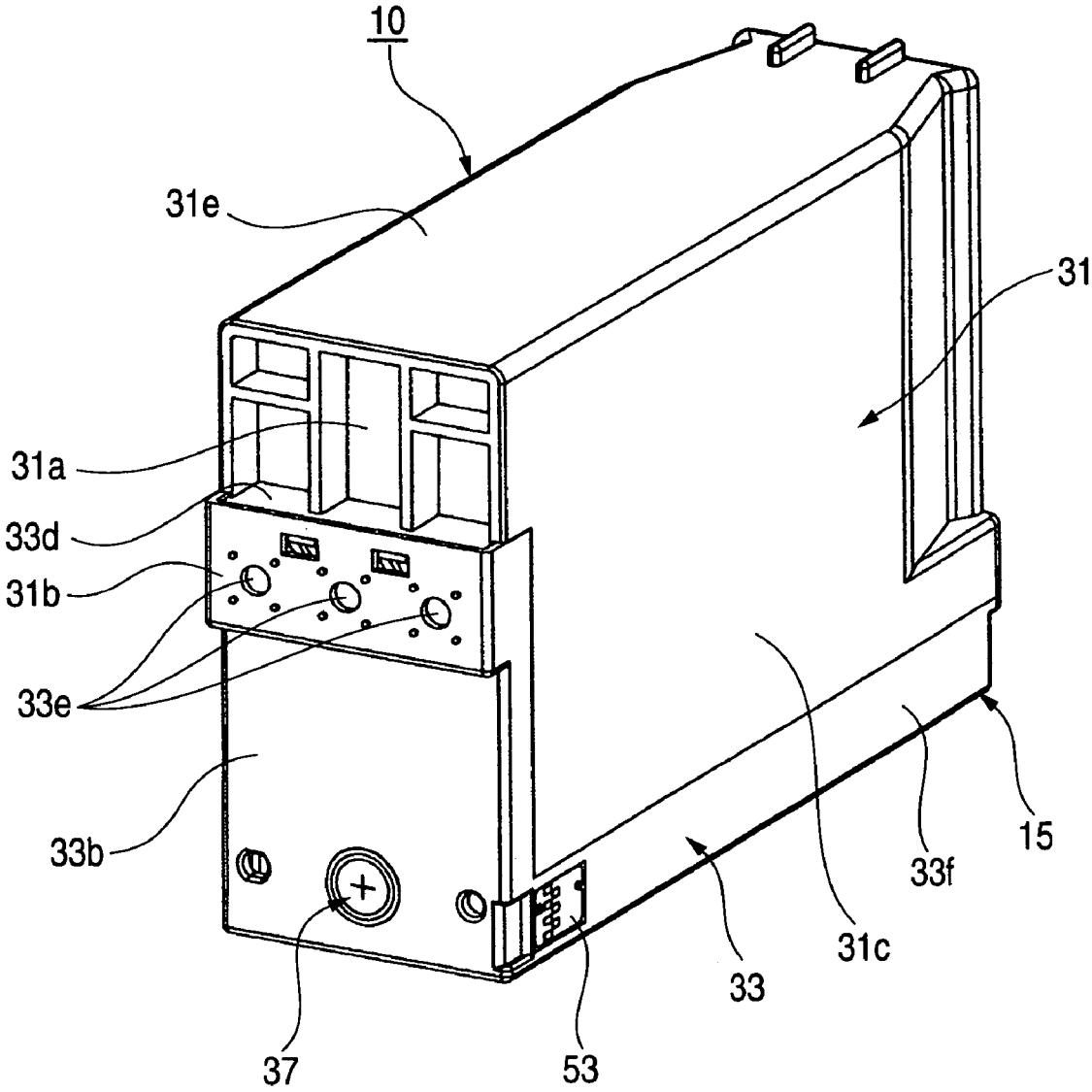
FIG. 2 is an overall perspective view of the ink cartridge shown in FIG. 1.
Figure 3:
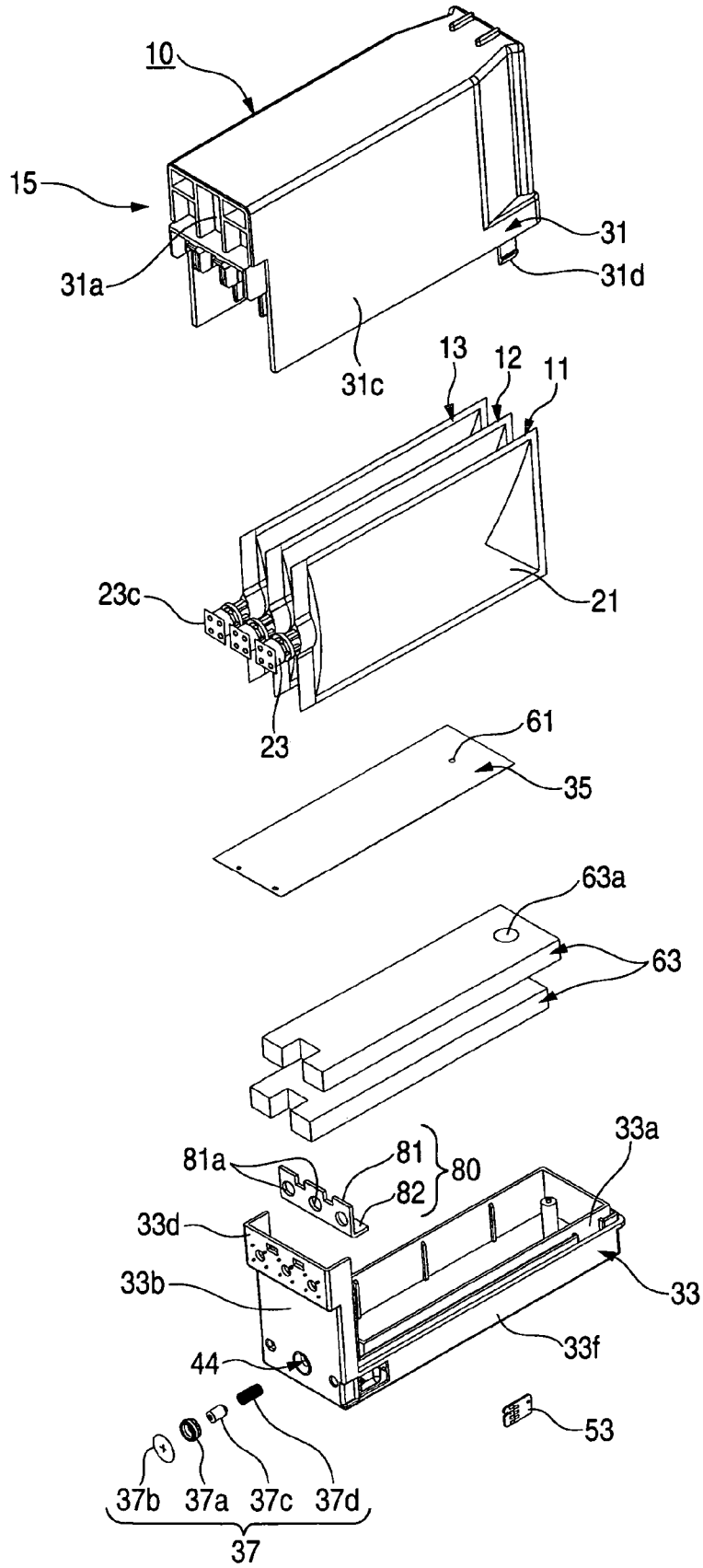
FIG. 3 is an exploded perspective view of the ink cartridge shown in FIG. 1.

As shown in FIGS. 2 and 3, the cartridge case 15 has an upper case 31, a lower case 33 that is connected to the bottom of the upper case 31, and an intermediate container wall 35 vertically divides a space defined by the upper case 31 and the lower case 33.

The upper case 31 and the lower case 33 are molded products formed of suitable plastic materials. The intermediate container wall 35 is formed of a plastic film.

The upper case 31 is in a box shape having an open bottom and a front container wall 31*a* thereof is set to be lower than side container walls and a rear container wall, as shown in FIGS. 2 and 4. Then, semicircular cylindrical outlet port positioning portions 31*b* are formed below the front container wall 31*a* so as to position upper halves of the ink outlet ports 23 of the individual ink packs 11 to 13. Three semicircular cylindrical outlet port positioning portions 31*b* are formed to correspond to the three ink packs 11 to 13 to be accommodated.

Anchoring protrusions 31*d* provided at the lower ends of side walls 31*c* in the periphery of the rear end that are to be the side container walls of the upper case 31 are engaged with engagement portions 33*a* of the lower case 33, such that the upper case 31 and the lower case 33 are connected to each other.

The lower case 33 is formed in a thin pan and box shape having an open top. A front container wall 33*b* is set to be higher than side container walls and a rear container wall. Outlet port positioning portions 33*c* are formed at an upper end of the front container wall 33*b* so as to position lower halves of the ink outlet ports 23 of the individual ink packs 11 to 13.

As shown in FIG. 4, the outlet port positioning portions 33*c* position and fix the ink outlet ports 23 of the individual ink packs 11 to 13, together with the outlet port positioning portions 31*b* of the upper case 31, by clamping the individual ink outlet ports 23 from above and below. Like the above-described outlet port positioning portions 31*b*, three outlet port positioning portions 33*c* are formed to correspond to the three ink packs 11 to 13 to be accommodated.

In this embodiment, the outlet port positioning portion 31*b* positions the ink outlet port 23 in an axial direction by causing a positioning brim portion 26 provided on an outer circumference of the cylindrical body 23*a* of the ink outlet port 23 to be engaged with a groove 27 formed on its inner circumferential surface. Further, the outlet port positioning portion 33*c* positions the ink outlet port 23 in a vertical direction by causing the outer circumference of the cylindrical body 23*a* of the ink outlet port 23 to be engaged with a semicircular cylindrical contact portion 28 provided at its top surface.

Further, a cover portion 33*d* is formed at the upper end of the front container wall 33*b* to extend from the front ends of the outlet port positioning portions 33*c* and to cover the front sides of the ink outlet ports 23. As shown in FIGS. 8 and 9, the ink supply openings (liquid supply openings) 33*e* that expose the ink outlet ports 23 positioned by the outlet port positioning portions 31*b* and 33*c* to the outside of the case are formed to pass through the cover portion 33*d*.

The ink supply openings 33*e* are openings into which the ink supply needles 41 provided in the cartridge mounting portion 9 of the ink jet printer 1 are inserted. Three ink supply openings 33*e* are formed so as to be correspondingly concentric with the three outlet port positioning portions 33*c*.

If the ink cartridge 10 is mounted on the cartridge mounting portion 9 of the ink jet printer 1, the ink supply needles 41 provided in the cartridge mounting portion 9 are correspondingly inserted into the ink outlet ports 23 of the individual ink packs 11 to 13. Then, the ink liquids in the individual ink packs 11 to 13 can be supplied to the printer.

Specifically, as shown in FIGS. 4 and 9, each of the ink supply needle 41 provided in the cartridge mounting portion 9 passes through the mouth member 24*a* of each of the ink outlet ports 23 and causes the valve mechanism 23*b* to be in a closed state. Accordingly, the ink liquid in the pouch body 21 of each of the ink packs 11 to 13 can be supplied to the printer through the ink supply needle 41. Supply tubes 42 that guide the ink liquid to a printing head of the printer are correspondingly connected to the ink supply needles 41.

In this embodiment, as shown in FIG. 9, the outlet port positioning portions 31*b* and 33*c* provided in the cartridge case 15 position the front ends of the ink outlet ports 23, that is, the outer ends 23*d*, at positions spaced at a predetermined gap s from the inner surface of the cover portion 33*d* of the lower case 33 having the ink supply openings 33*e* formed therein to the inside of the case. That is, the gap s is secured between the inner surface of the cover portion 33*d* and the front end of the ink outlet port 23 to flow.

The gap s causes ink liquids dripping from the ink outlet ports 23 to flow into the cartridge case 15 when the ink cartridge 10 is removed from the cartridge mounting portion 9 of the ink jet printer 1 for the replacement of the ink cartridge 10 or the like and the ink supply needles 41 are removed from the ink outlet ports 23.

The gap s is appropriately set according to properties of the ink liquid, such as viscosity or fluidity such that the ink liquid remains between the inner surface of the cover portion 33*d* serving as an inner surface of the cartridge case having the ink supply openings 33*e* formed therein and the front ends of the ink outlet ports 23 as a meniscus.

As shown in FIGS. 8 and 9, an angular portion 34 close to the inner surface of the cover portion 33*d* has an R section having a radius enough to prevent the stuck ink liquid from flowing out from the cartridge case 15.

In this embodiment, an ink absorption member (liquid absorption member) 80 that absorbs the ink liquid is provided between the inner surface of the cover portion 33*d* and the front ends of the individual ink outlet ports 23.

As shown in FIGS. 3 and 9, the ink absorption member 80 substantially has an L sectional shape having a flat plate portion 81 that is provided to fill the gap s along the inner surface of the cover portion 33*d* extending from the front container wall 33*b*, and a seat plate portion 82 that is provided upright from a lower end of the flat plate portion 81 and then accommodated in a blank space p below the front end of the cylindrical body 23*a*. The seat plate portion 82 is placed on a step between the front container wall 33*b* and the cover portion 33*d* to be then positioned.

Openings 81*a* are formed in the flat plate portion 81 to have a diameter larger than the ink supply openings 33*e* to be concentric with the ink supply openings 33*e* or the ink outlet ports 23. The ink supply needles 41 are inserted into the openings 81*a*.

As a specific material of the liquid absorption member 80, for example, in addition to porous materials, such as sponge or nonwoven fabric, a liquid absorbent polymer can be used.

In the lower case 33 of this embodiment, as shown in FIG. 8, the front container wall 33*b* is disposed below the cover portion 33*d* having the ink supply openings 33*e* formed therein to be connected to the cover portion 33*d*. On the inner surface of the front container wall 33*b*, reinforcing ribs 84 are integrally formed to vertically extend corresponding to positions supporting the ink outlet ports 23.

As shown in FIGS. 8 and 9, the upper end surfaces of the ribs 84 form the outlet port positioning portions 33*c*. Each of the ribs 84 is set such that a size w in a widthwise direction of the case is smaller than the outer diameter of each of the ink outlet ports 23. If the ink liquid leaking from each of the ink outlet ports 23 flows to the step between the front container wall 33*b* and the cover portion 33*d*, the ink liquid flows from the step to the lower end of the front container wall 33*b* along the inner surface on both sides of each of the ribs 84 (the inner surface of the front container wall 33*b*). Moreover, each of angular portions 84*a* close to a base portion of each of the ribs 84 has an R section having a sufficiently small radius such that the stuck ink liquid easily moves downward by a capillary force.

In this embodiment, as shown in FIGS. 4 and 7, a liquid storage space 86 that stores the ink liquid flowing along the inner surface of the front container wall 33*b* is provided at a position that extends to the lower end of the inner surface of the front container wall 33*b*. Further, the position of the liquid storage space 86 is set to be lower than a lower end position of an ink pack accommodating space 55 that accommodates the ink packs 11 to 13 (that is, a position at which the intermediate container wall 35 is provided). Still further, the liquid storage space 86 may be provided with a liquid absorption member so as to absorb the ink liquid flowing along the inner surface of the front container wall 33*b*.

An waste ink inlet 44 that constitutes a waste ink inlet portion 37 in the waste ink storage structure 17 is formed at a position in the periphery of a lower portion of the front container wall 33*b*.

As shown in FIG. 3, the waste ink inlet portion 37 has a tapered tube-shaped rubber mouth member 37*a* that has a wider inner diameter at its front end, a seal film 37*b* that is adhered to the front end of the rubber mouth member 37*a*, a valve body 37*c* that comes into contact with a rear end of the rubber mouth member 37*a* to close an opening of the rubber mouth member 37*a*, and a compressed coil spring member 37*d* that brings the valve body 37*c* into contact with the rubber mouth member 37*a*, and presses and biases the valve body 37*c* to be closely adhered to the valve body 37*c*.

If the ink cartridge 10 is mounted on the cartridge mounting portion 9 of the ink jet printer 1, a waste ink pouring needle 47 provided in the cartridge mounting portion 9 is engaged with the rubber mouth member 37*a* airtight, and the valve body 37*c* is pressed. Then, waste ink can be poured into the storage space 51 through the waste ink pouring needle 47 (see FIG. 4).

A waste ink guiding tube 49 that guides waste ink generated at the time of an ink filling operation or a head cleaning operation of the ink jet printer 1 is connected to the waste ink pouring needle 47.

As shown in FIGS. 2 and 3, an IC module 53, in the lower case 33, an IC module 53 that can record the kinds of the ink packs 11 to 13, a residual ink quantity, and other kinds of data is provided on a side container wall 33*f* of the lower case 33.

If the ink cartridge 10 is mounted on the cartridge mounting portion 9 of the ink jet printer 1, the IC module 53 is electrically connected to a connection terminal provided in the cartridge mounting portion 9. Accordingly, information can be read and written from and into a printer control circuit or a computer to which the printer is connected.

The intermediate container wall 35 that is a container wall formed of a plastic film, such as a polyethylene film or the like, is set such that its circumferential portion is superimposed on the upper end surfaces of the side container walls 33*f* and the front and rear container walls 33*g* and 33*h* of the lower case 33 (see FIG. 4). Then, the superimposed portions are bonded using a heat welding method or the like, such that the intermediate container wall 35 is fixed to the lower case 33 while being slightly tensioned.

The intermediate container wall 35 is fixed to the lower case 33 so as to cover an upper opening of the lower case 33. Then, as shown in FIG. 4, the storage space 51 constituting the waste ink storage structure 17 is defined between a bottom wall 33*i* of the lower case 33 and the intermediate container wall 35. In addition, an ink pack accommodating space 55 that accommodates the three ink packs 11 to 13 upright as shown in FIG. 3 is defined between a top wall 31*e* of the upper case 31 and the intermediate container wall 35.

As shown in FIG. 4, the waste ink storage structure 17 of this embodiment has the storage space 51 that is defined by the lower case 33 and the intermediate container wall 35 and stores waste ink, the waste ink inlet portion 37 that pours waste ink into the storage space 51, a vent 61 that connects the storage space 51 to the outside, two ink absorption members 63 that are provided in the storage space 51 so as to absorb waste ink poured into the storage space 51 from the waste ink inlet portion 37, and an open-close valve 65 that opens/closes the vent 61.

As shown in FIGS. 3 and 4, the waste ink inlet portion 37 that pours waste ink into the storage space 51 is provided at the waste ink inlet 44 formed in the front container wall 33*b* that is a part of a container wall defining the storage space 51.

As shown in FIG. 4, a rear end (a left end in FIG. 4) of the waste ink inlet 44 is connected to the storage space 51. Then, waste ink to be poured from the waste ink pouring needle 47 inserted into the waste ink inlet portion 37 flows from the rear end of the waste ink inlet 44 into the storage space 51.

The vent 61 formed in the intermediate container wall 35 is a circular opening that exposes the storage space 51 to the air. A position at which the vent 61 is to be formed is preferably a position that waste ink finally reaches within the storage space 51.

The ink absorption members 63 absorb poured waste ink such that waste ink poured into the storage space 51 through the waste ink inlet portion 37 and the waste ink inlet 44 does not flow backward to the waste ink inlet portion 37 and leak to the outside.

The ink absorption members 63 are molded in rectangular shapes so as to be accommodated in the storage space 51 using a liquid absorbent material. As a specific material, in addition to porous materials, sponge or nonwoven fabric, a liquid absorbent polymer can be used.

The open-close valve 65 provided at the vent 61 opens the vent 61 only when waste ink is poured and releases air in the storage space 51 so as not to obstruct the pouring of waste ink from the waste ink inlet portion 37.

In this embodiment, as a plastic film used for the intermediate container wall 35 having the vent 61, a plastic film having flexibility to be expanded by an pouring pressure of waste ink from the waste ink inlet portion 37 is selected.

In this embodiment, as shown in FIG. 4, the open-close valve 65 has the intermediate container wall 35 having the vent 61, and a valve structure member 67 that is provided within the storage space 51 such that its front end comes into contact with the circumference of the vent 61 so as to close the vent 61.

The valve structure member 67 that is a cylindrical support has a positioning protrusion 67*a* that is provided at its front end to pass through the vent 61. The valve structure member 67 is formed integrally with the bottom wall 33*i* of the lower case 33 that faces the vent 61. A hole 63*a* (see FIG. 3), into which the valve structure member 67 is inserted, is formed in the two ink absorption members 63 provided in the storage space 51.

As shown in FIG. 4, in the open-close valve 65, the front end surface of the valve structure member 67 comes into contact with the circumference of the vent 61 so as to close the vent 61. The open-close valve 65 is kept to be in a closed state excluding when waste ink is poured from the waste ink inlet portion 37.

If a pressure in the storage space 51 is increased due to the pouring of waste ink, the intermediate container wall 35 is transformed and the open-close valve 65 expands upward. Then, the circumference of the vent 61 is spaced away from the front end surface of the valve structure member 67, and thus the open-close valve 65 exposes the storage space 51 to the air through the vent 61.

According to the ink cartridge 10 of this embodiment described above, the front ends of the liquid outlet ports 23 of the individual ink packs 11 to 13 are positioned and fixed at the positions spaced inwardly at the predetermined gap s from the liquid supply openings 33*e* of the cartridge case 15.

Then, even though leakage of the ink liquid from the liquid outlet ports 23 when the ink cartridge 10 is removed from the cartridge mounting portion 9 of the ink jet printer 1 and the ink supply needles 41 are removed from the liquid outlet ports 23, the leakage ink liquid does not flow into the cartridge case 15 and does not flow out from the cartridges case 15.

Therefore, according to the ink cartridge 10 of this embodiment, when the ink cartridge 10 is removed from the cartridge mounting portion 9, the ink liquid leaking from the ink outlet ports 23 does no stain the printer 1, peripheral matters, or the hands of a worker. As a result, operationality and a handling property at the time of the replacement of the cartridge or the like can be improved.

According to the ink cartridge 10 of the above-described embodiment, the ink liquid leaking from the ink outlet ports 23 when the ink cartridge 10 is removed from the cartridge mounting portion 9 flows between the inner surface of the cover portion 33*d* of the cartridge case 15 having the ink supply openings 33*e* formed therein and the front ends of the ink outlet ports 23. Subsequently, the ink liquid is absorbed by the liquid absorption member 80 to be then collected.

For this reason, even though the ink supply openings 33*e* of the removed cartridge case 15 are turned downward, the collected ink liquid rarely flows backward and flows out from the ink supply openings 33*e* to the outside. As a result, reliability for a function of collecting the leakage ink liquid can be improved.

According to the ink cartridge 10 of the above-described embodiment, the liquid storage space 86 that stores the ink liquid flowing along the inner surface of the cartridge case 15 is provided at a lower position extended to the inner surface of the cartridge case 15 having the ink supply openings 33*e* formed therein.

Even though the amount of the leakage ink liquid from the liquid outlet ports 23 is increased due to the repetition of the attachment and detachment of the ink cartridge 10 to and from the cartridge mounting portion 9 of the ink jet printer 1, the leakage ink liquid can be reliably collected.

According to the ink cartridge 10 of the above-described embodiment, the liquid storage space 86 is set to be lower than the position where the ink packs 11 to 13 in the cartridge case 15 are accommodated. Accordingly, the ink liquid that leaks from the liquid outlet ports 23, flows down within the cartridge case 15, and is stored in the liquid storage space 86 do not flow to the ink packs 11 to 13 accommodated above the liquid storage space 86, unless the cartridge case 15 is horizontally inclined or reversed. Therefore, the collected ink liquid can be prevented from being stuck to the ink packs 11 to 13. When the liquid absorption member is provided in the liquid storage space 86, the liquid stored in the liquid storage space 86 does not flow to the ink packs 11 to 13, even if the cartridge case 15 is horizontally inclined or reversed.

For this reason, it is possible to prevent the situation in which a worker who performs replacement of the liquid packs 11 to 13 or the like stains his/her hands with the leakage ink liquid stuck to the ink packs 11 to 13. Therefore, operationality and a handling property at the time of the replacement of the ink packs 11 to 13 or the like are improved.

Next, a second embodiment according to the invention will be described with reference to FIGS. 10 to 13. In these drawings, parts having the same function as that in the first embodiment are represented by the same reference numerals, and the descriptions thereof will be omitted. In particular, the shape and function of the ink absorption member (liquid absorption member) in the second embodiment are different from that in the first embodiment.

Figure 10:
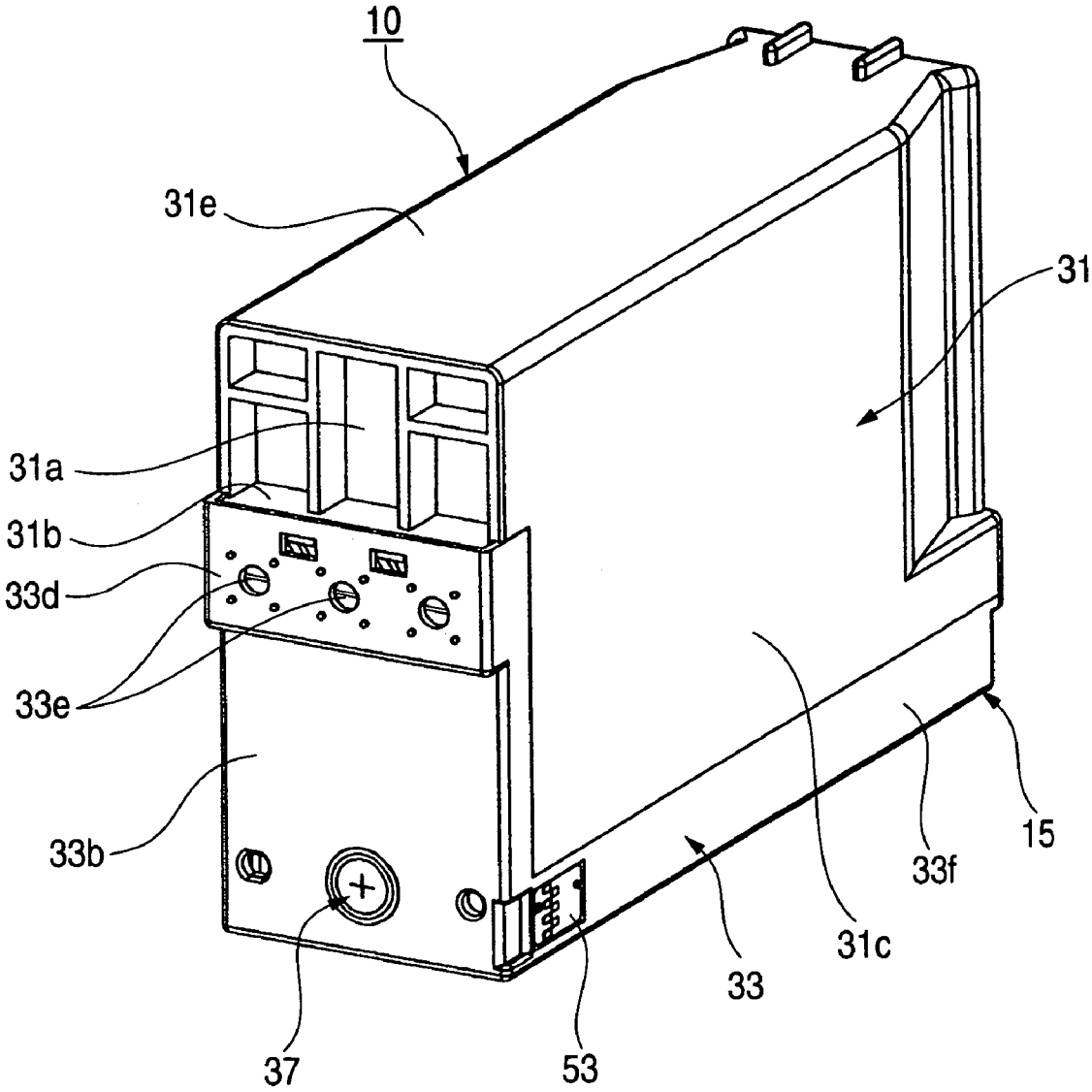
FIG. 10 is an overall perspective view of an ink cartridge according to another embodiment of the invention.
Figure 11:
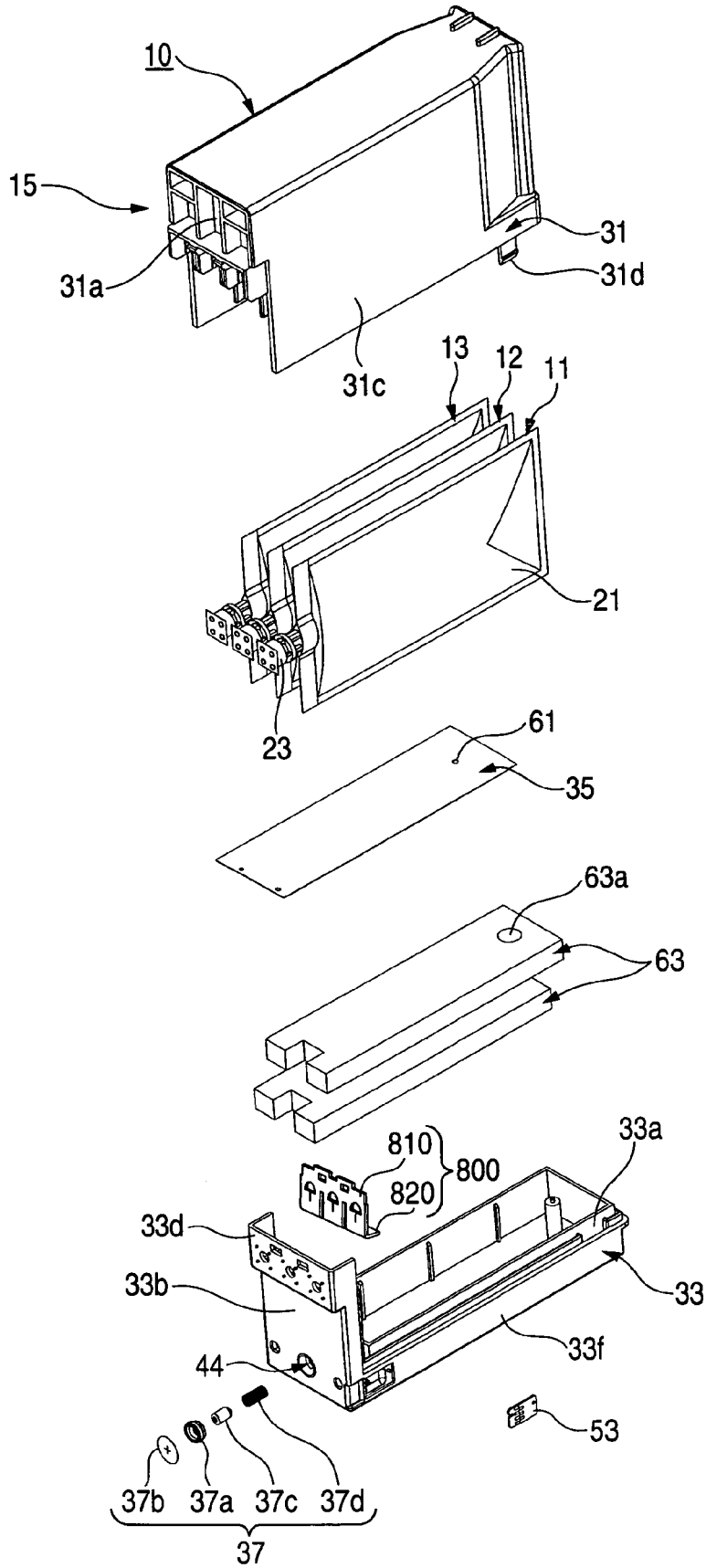
FIG. 11 is an exploded perspective view of the ink cartridge shown in FIG. 10.
Figure 12:
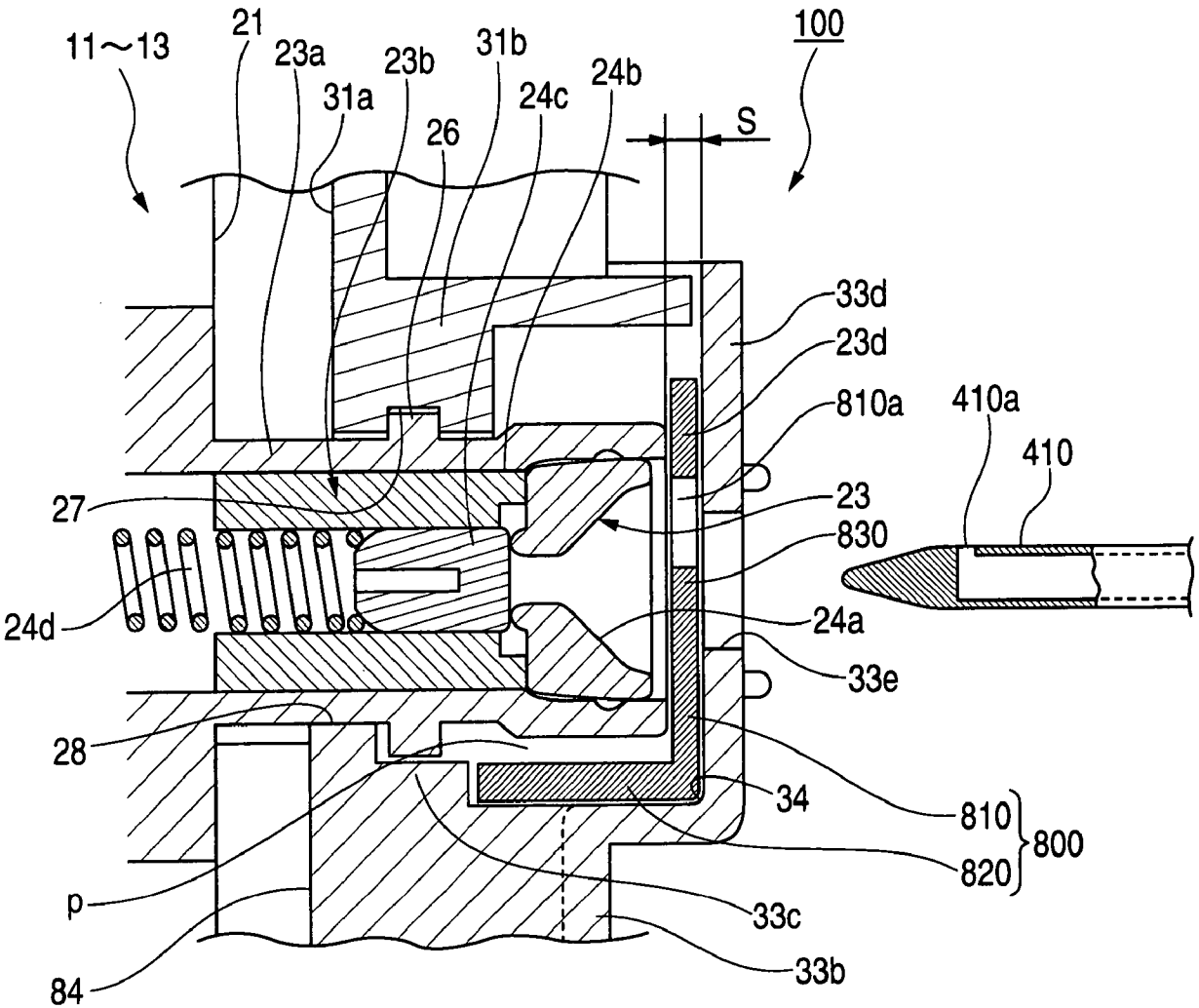
FIG. 12 is an expanded cross-sectional view of the ink cartridge shown in FIG. 10.
Figure 13:
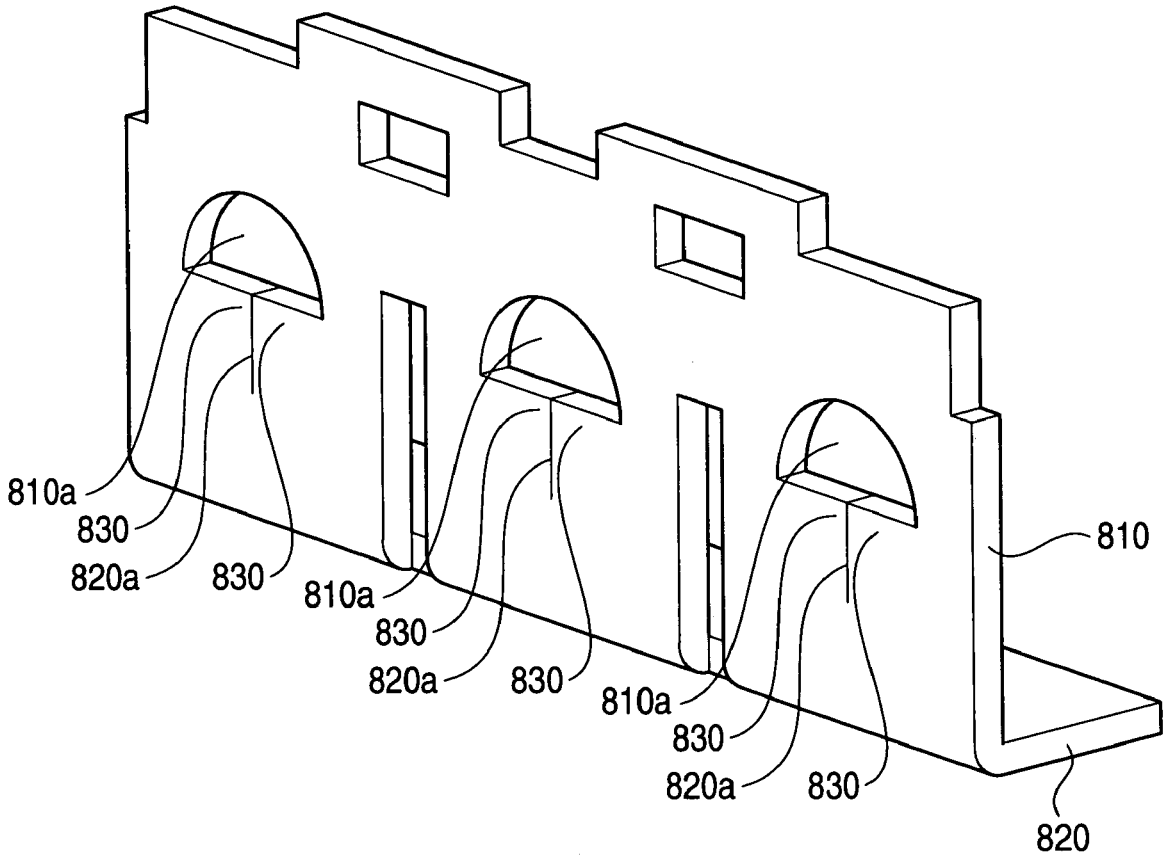
FIG. 13 is an exploded perspective view of an ink absorption member shown in FIG. 10.
Figure 14:
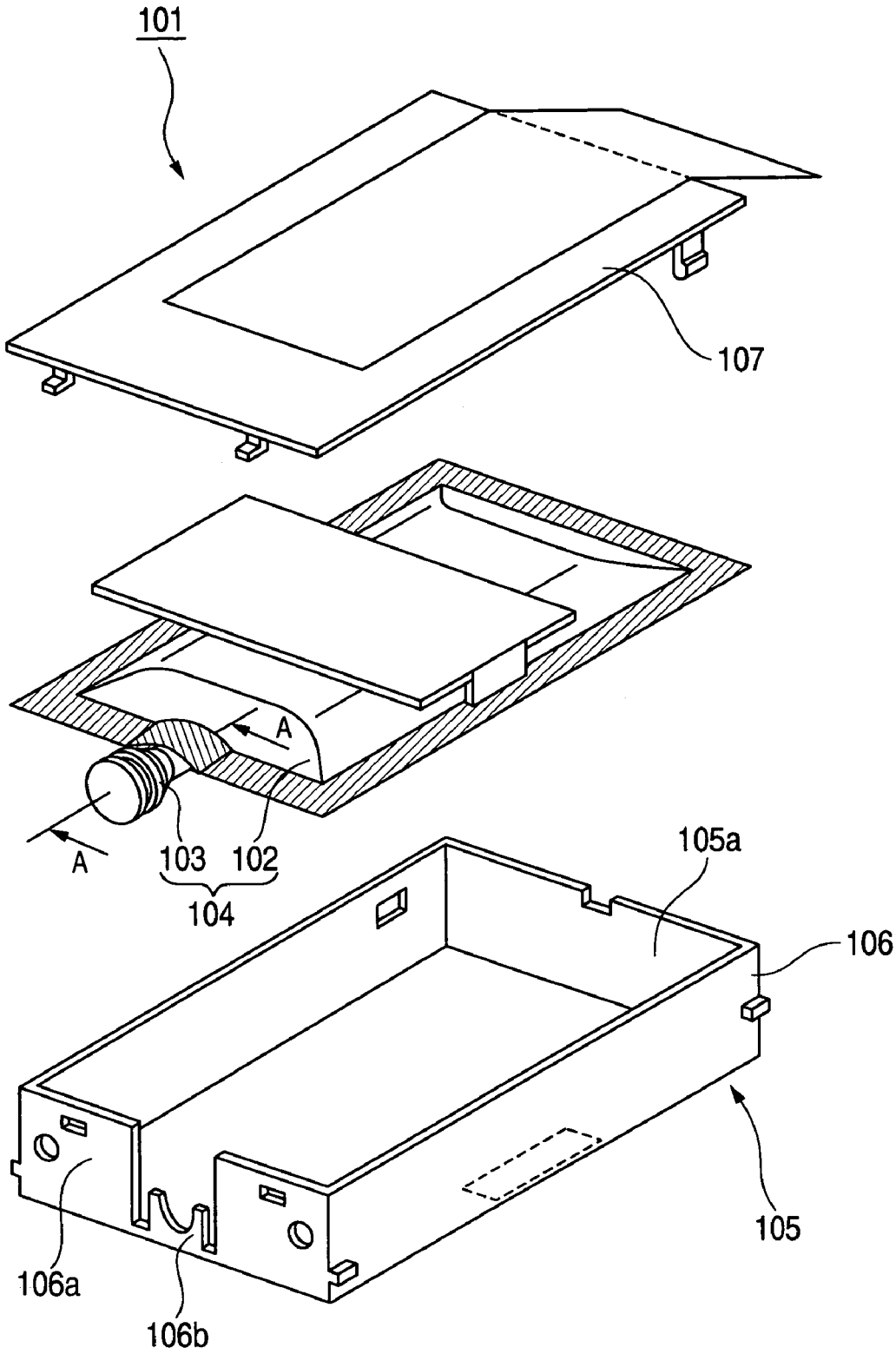
FIG. 14 is an exploded perspective view of a conventional ink cartridge.
Figure 15:
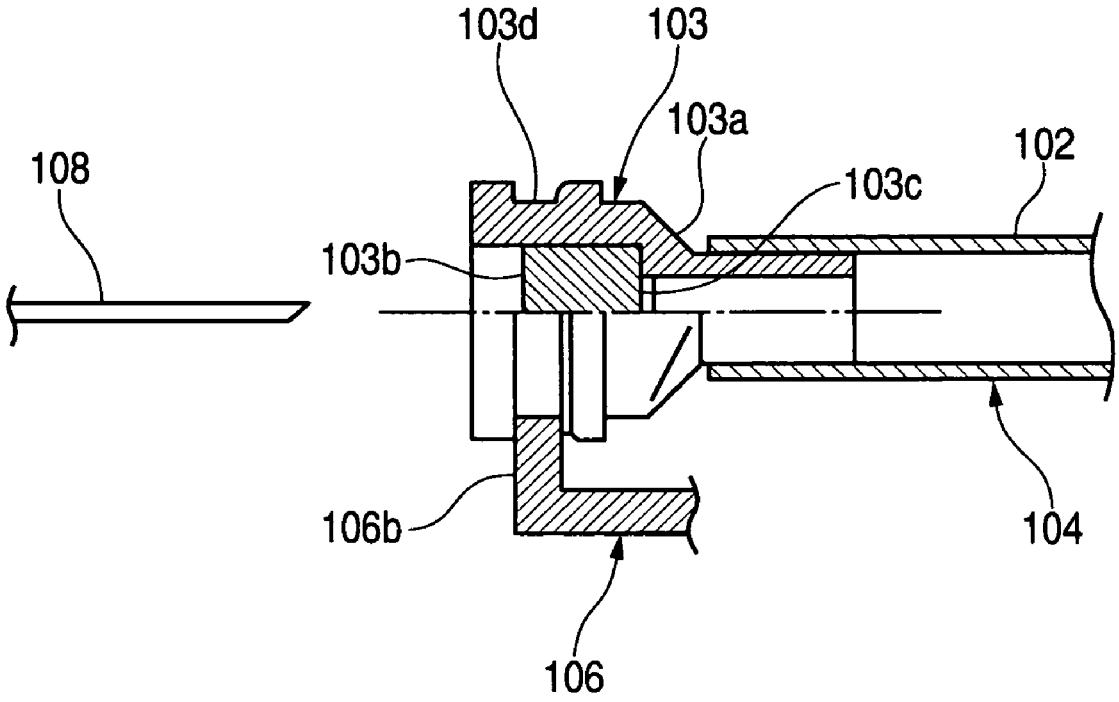
FIG. 15 is a cross-sectional view showing the periphery of an ink outlet port of the ink cartridge taken along the line XV-XV of FIG. 14

FIG. 10 is an overall perspective view of an ink cartridge according to the second embodiment. FIG. 11 is an exploded perspective view of the ink cartridge shown in FIG. 10. FIG. 12 is an expanded cross-sectional view of the ink cartridge. FIG. 13 is an expanded perspective view of an ink absorption member. In the second embodiment, as shown in FIGS. 10 to 13, an ink absorption member (liquid absorption member) 800 that absorbs ink liquid is provided between the inner surface of a cover portion 33*d* and front ends of ink outlet ports 23.

As shown in FIGS. 11 and 13, the ink absorption member 800 substantially has an L sectional shape having a flat plate portion 810 that is provided to bury the gap s along the inner surface of the cover portion 33*d* extending from the front container wall 33*b*, and a seat plate portion 820 that is provided upright at a lower end of the flat plate portion 810 and is accommodated in a black space p below a front end of a cylindrical body 23*a*. The seat plate portion 820 is placed on a step between the front container wall 33*b* and the cover portion 33*d* to be then positioned.

Semicircular openings 810*a* are formed in the flat plate portion 810 so as to be substantially concentric with the centers of the ink supply openings 33*e* or the ink outlet ports 23, respectively, and only the upper halves thereof are opened. The openings 810*a* have semicircular shapes larger than the diameter of the individual ink supply openings 33*e*. In the first embodiment, each of the ink outlet ports 23 is exposed by the area of each of the ink supply openings 33*e*. Meanwhile, in the second embodiment, since the lower halves of the ink supply openings 33*e* are covered with the ink absorption member 800, only the upper halves of the ink supply openings 33*e* are exposed.

Slits 820*a* that extend from the centers of the individual semicircular openings 810*a* downward are provided in the ink absorption member 800, such that a contact portion 830 covering the ink supply openings 33*e* can be easily displaced.

In the second embodiment, in each of ink supply needles 410 of the cartridge mounting portion 9 of the ink jet printer 1, an introduction hole 410*a* for introducing ink is provided at an upper portion of its circumferential portion.

If the ink cartridge 100 having the above-described configuration is mounted on the cartridge mounting portion 9 of the ink jet printer 1, the ink supply needles 410 provided in the cartridge mounting portion 9 come into contact with the contact portions 830, respectively. Then, the lower portions of outer circumferences of the ink supply needles 410 are correspondingly inserted into and connected to the ink outlet ports 23 of the individual ink packs 11 to 13 while displacing the contact portions 830 to be spaced away from the slits 820*a*. Accordingly, the ink liquids in the individual ink packs 11 to 13 can be supplied to the printer. As such, the sides of the ink supply needles 410 not having the introduction holes 410*a* slide into contact with the ink absorption member 800, and the introduction holes 410*a* do not slide into contact with the ink absorption member 800 by the openings 810*a*. Therefore, foreign substances or fragments of the ink absorption member do not enter the introduction holes 410*a*. Further, since the slits 820*a* are disposed on the contact portions 830 of the ink absorption member 800, when the ink supply needles 410 are inserted into the ink cartridge 100, the ink supply needles 410 do not damage the flat plate portion 810.

Next, a case where the ink cartridge 100 is removed from the cartridge mounting portion 9 will be described. Although ink easily sticks to the outer circumferences of the ink supply needles 410, since the outer circumferences of the ink supply needles 410 slide into contact with the contact portions 830 of the ink absorption member 800, ink stuck to the outer circumferences of the ink supply needles 410 seeps into the contact portions 830. Accordingly, it is possible to prevent the outer surface of the ink cartridge 100 or the ink jet printer 1 from being stained. In addition, the contact portions 830 of the ink absorption member 800 are displaced toward the ink outlet ports 23, thereby rapidly absorbing ink leaking from the ink outlet ports 23. As a result, there is little possibility that the ink cartridge 100 or the ink jet printer 1 is stained with leakage ink.

Although the openings of the ink absorption member 800 are in the semicircular shapes in the second embodiment, the openings may be in U shapes. Alternatively, when the introduction hole of each of the ink supply needles is disposed at its front end, a small hole in contact with the outer circumference may be provided and a radial slit may be provided. What is necessary is that the opening comes into contact with or easily comes into contact with the outer circumference of the ink supply needle. In view of ease of manufacturing, the opening is preferably formed in the semicircular shape.

The use of the liquid container according to the invention is not limited to the ink cartridge mounted on the ink jet printer. The liquid container according to the invention can be used as various liquid containers in various liquid ejection apparatuses, such as ink jet printers or the like. In this case, if the liquid container is mounted on the cartridge mounting portion, liquid supply members of the liquid ejection apparatus are inserted into and connected to liquid outlet ports of liquid packs in a cartridge case, and then liquid within the ink packs can be supplied to the apparatus.

The liquid ejection apparatus according to the invention is not limited to the ink jet printer described in the above-described embodiments. For example, the invention can be applied to a liquid ejection apparatus that uses a liquid jetting head ejecting a liquid, such as a color material jetting head used in manufacturing color filters of a liquid crystal display or the like, an electrode-material jetting head used in forming electrodes of an organic electroluminescent (EL) display or an FED (surface emission display), a bioorganic compound jetting head used in manufacturing a bio-chip, or the like, and a sample spraying head as a precision pipette.

What is claimed is:

1. A liquid container comprising:

a containing portion, adapted to store liquid;

a liquid outlet port, adapted to flow out the liquid from the containing portion therethrough;

an outer wall, having a liquid supply opening for exposing the liquid outlet port to an outside, and covering a periphery of the liquid outlet port while the outer wall keeps a predetermined gap from an outer end of the liquid outlet port; and a first liquid absorption member, disposed at the predetermined gap so as to absorb the liquid, wherein the first liquid absorption member includes a contact portion which is disposed between the liquid outlet port and the liquid supply opening of the outer wall, covers an outer portion of the liquid outlet port, and is configured to contact an outer circumference of a liquid supply needle when the liquid supply needle is inserted into the containing portion through the liquid supply opening and the liquid outlet port; and wherein slits are formed in the contact portion of the first liquid absorption member.

2. The liquid container according to claim 1, wherein the first liquid absorption member covers the liquid outlet port to decrease an exposed portion of the liquid outlet port from the liquid supply opening.

3. The liquid container according to claim 1, wherein the first liquid absorption member covers the liquid outlet port such that the liquid outlet port is bisected.

4. The liquid container according to claim 1, further comprising a liquid storage space, disposed at a position on a downstream side of an inner surface of the outer wall and adapted to store the liquid flowing along the inner surface of the outer wall.

5. The liquid container according to claim 4, wherein the containing portion is a liquid pack, and the liquid storage space is disposed to be lower than a position where the liquid pack is accommodated.

6. The liquid container according to claim 5, further comprising a second liquid absorption member disposed in the liquid storage space so as to absorb the liquid.

7. The liquid container according to claim 4, further comprising a rib extending along the outer wall to the liquid storage space.

8. The liquid container according to claim 7, wherein a width of the rib is smaller than an outer diameter of the liquid outlet port.

9. The liquid container according to claim 7, wherein a boundary between the rib and the outer wall is rounded.

10. An ink cartridge comprising the liquid container according to claim 1, wherein the liquid to be contained in the liquid container is an ink liquid.

11. An ink jet printer comprising the ink cartridge according to claim 10.

12. The liquid container according to claim 1, wherein the predetermined gap is set according to the properties of the liquid.

13. The liquid container according to claim 1, wherein the first liquid absorption member comprises a flat plate portion and a seat plate portion.

14. The liquid container according to claim 13, wherein substantially semicircular openings are formed in the flat plate portion, said substantially semicircular openings being formed concentric with centers of said liquid supply opening so that an upper half of said liquid supply opening is exposed.

15. The liquid container according to claim 14, wherein slits extending downward from said semicircular openings are formed.

16. The liquid container according to claim 13, wherein U-shaped openings are formed in the flat plate portion.

17. The liquid container according to claim 1, wherein the portion of the first liquid absorption member covering the portion of the liquid outlet port is arranged at least near the center of the liquid outlet port.

18. A liquid container comprising:

a containing portion, adapted to store liquid;

a liquid outlet port, adapted to flow out the liquid from the containing portion therethrough;

an outer wall, having a liquid supply opening for exposing the liquid outlet port to an outside, and covering a periphery of the liquid outlet port while the outer wall keeps a predetermined gap from an outer end of the liquid outlet port; and a first liquid absorption member, disposed at the predetermined gap so as to absorb the liquid, wherein the liquid outlet port has a circular shape; and wherein the first liquid absorption member is formed with an opening having a semicircular shape such that a portion of the first liquid absorption member covers a half area of the circular shape of the liquid outlet port.

* * * * *